US005332862A

United States Patent [19]

Kakishita et al.

[11] Patent Number: 5,332,862

[45] Date of Patent: Jul. 26, 1994

[54] MUSICAL TONE SYNTHESIZING APPARATUS INCLUDING MODULATOR ON ITS NON-LINEAR/LINEAR OUTPUTS

[75] Inventors: Masahiro Kakishita; Toshifumi Kunimoto, both of Hamamatsu, Japan

[73] Assignee: Yamaha Corporation, Shizuoka, Japan

[21] Appl. No.: 957,714

[22] Filed: Oct. 7, 1992

[30] Foreign Application Priority Data

Nov. 1, 1991 [JP] Japan ..... 3-288111

[51] Int. Cl.[5] ..... G10H 1/06

[52] U.S. Cl. ..... 84/659; 84/DIG. 10

[58] Field of Search ..... 84/621-625, 84/659-661, DIG. 9, DIG. 10

[56] References Cited

U.S. PATENT DOCUMENTS 4,984,276 1/1991 Smith .

5,167,179 12/1992 Yamaguchi et al. ..... 84/621 X 5,182,415 1/1993 Kunimoto ..... 84/660

*Primary Examiner*—Stanley J. Witkowski

[57] ABSTRACT

A musical tone synthesizing apparatus includes a linear operation device, a non-linear operation device and a musical tone modification device. When the linear operation device receives a progressive wave signal, the device progresses and delays the signal, and outputs the progressed and delayed signal. The non-linear operation device varies the signal outputted by the linear operation device according to a musical tone control signal, and generates the varied signal as a new progressive wave signal. The musical tone modification device receives a plurality of signals extracted from the linear operation device or the non-linear operation device, creates a first signal and a second signal based on the plurality of signals, varying the first signal in accordance with the second signal, and provides the varied first signal as a musical tone signal to be synthesized.

14 Claims, 10 Drawing Sheets

SOUND CREATION EFFECTING DEVICE 104

CARRIER MIXER 1

NON-LINEAR OPERATION PART 101

MUSICAL TONE SYNTHESIZING APPARATUS INCLUDING MODULATOR ON ITS NON-LINEAR/LINEAR OUTPUTS

BACKGROUND OF THE INVENTION

1. Field of the Invention

The present invention relates to a musical tone synthesizing apparatus which allows simple creation of sounds.

2. Background Art

Conventionally, there is known a technique wherein the sound generation mechanism of an acoustic instrument is simulated by a DSP (i.e., a Digital Sound Processor), etc., and whereby the musical tone of the instrument is composed. For example, a schematic algorithm of a physical model sound source, which has been utilized for simulation of acoustic wind instruments, will be described with reference to FIG. 7.

In FIG. 7, the numeral 101 designates a non-linear operation part which simulates the non-linear part of an acoustic wind instrument, namely, the reed. The numeral 102 designates a linear operation part which simulates the linear part of the acoustic wind instrument, namely, the resonance tube. The numeral 103 designates a digital-to-analog converter (hereinafter referred to as a "DAC") which measures pressure wave signals and other signals passing between the non-linear operation part 101 and the linear operation part 102. The DAC 103 further converts the measured signals to an analog signal and outputs the analog signal as a musical tone signal.

The non-linear operation part 101 receives a blow pressure signal PRE which represents the blowing pressure of the performer, and receives an embouchure signal EMB which represents the strain of lips of the performer, respectively, from external circuits. The non-linear operation part 101 further receives a reflected pressure wave signal $q_i$ from the linear operation part 102. The part 101 then generates a progressive pressure wave signal $q_0$ in response to the received data and signals. The progressive pressure wave signal $q_0$, generated by the non-linear operation part 101, is then supplied to the linear operation part 102 wherein the signal $q_0$ is reflected and attenuated while passing through the part 102. As a result, the signal $q_0$ is returned to the non-linear operation part 101 as a new reflected pressure wave signal $q_i$.

Next, details of the linear operation part 102 will be described with reference to FIG. 8.

In the drawing, the numerals 113, 114 and 119 respectively, designate delay circuits which simulate the propagation delay of pressure waves occurred in the resonant tube of the acoustic wind instruments. The numerals 115 and 120, respectively designate low-pass filters (hereinafter referred to as "LPF") which respectively simulate the propagation losses of the pressure waves occurring in the resonance tube. The numerals 110 and 116 respectively designate multipliers, which respectively multiply the passing signals therein by reflection coefficients REFS and REFL, so as to simulate the losses occurring in the both ends of the resonance tube.

The numeral 200 designates a junction which simulates a tone hole provided in the resonant tube of acoustic wind instruments. The components described above are connected to each other so as to compose a loop circuit. The signals passing through the components simulate the progressive pressure waves and reflected pressure waves in the resonance tube.

The progressive pressure wave signal $q_0$ generated by the non-linear operation part 101 is supplied to multiplier 121 and 118. In the multiplier 118, the supplied progressive pressure wave signal $q_0$ is multiplied by an input gain constant NLSO, and the multiplication result is added to the reflected pressure wave signal at an adder 117. Therefore, influences applied to the reflected pressure wave by the blowing pressure can be simulated. Similarly, the progressive pressure wave signal $q_0$ is multiplied by an input gain constant NLLO in a multiplier 122, the multiplication results thereof are added to the progressive pressure wave signal by an adder 112, and the influences applied to the progressive pressure wave by the blowing pressure can also be simulated.

Then, the progressive pressure wave signal generated via the LPF 120 and multiplier 110 is multiplied by an output gain NLSI of the linear part at a multiplier 111; the multiplication results thereof are then supplied to an adder 123. Similarly, the reflected pressure wave signal at the prior stage of adder 117 is multiplied by output gain NLLI of the linear part via a multiplier 121, and the multiplication results thereof are then supplied to the adder 123. The signals supplied to the adder 123 are then added by the adder 123, and the addition results are supplied to the non-linear operation part 101 as the reflected pressure wave signal $q_i$.

As described above, in the linear operation part 102 shown in FIG. 8, the pressure wave signal is passed through the loop circuit consisting of delay circuits 113, 114, and 119, LPFs 115 and 120, etc., while being influenced by progressive pressure wave signal $q_o$. As a result, the reflected pressure wave signal $q_i$ is formed and returned to the non-linear operation part 101.

Next, details of the non-linear operation part 101 will be described with reference to FIG. 9.

In FIG. 9, the numeral 140 designates a subtracter, subtracting the blow pressure signal PRE from the reflected pressure wave signal $q_i$, generates the subtraction results as a difference pressure signal $\Delta q$. The difference pressure signal $\Delta q$ is then supplied to a digital controlled filter 142 via a subtracter 141, simultaneously supplied to a Graham function table 148 via a multiplier 147, and simultaneously supplied to a repulsing function table 150.

The digital controlled filter 142, belonging to the secondary low-pass filter, has a cut-off frequency and an amplitude build-up ratio (Q) respectively given by variables LPFR and QLR. Furthermore, because the embouchure data EMB is supplied to the digital controlled filter 142, characteristics such as the cut-off frequency, etc., are set accordingly. The output signal of the digital controlled filter 142 is added with embouchure data EMB in adder 143. As a result, frequency response of the difference pressure signal $\Delta q$ is set in response to conditions of performer's lips, so that the frequency setting mechanism of the performer's lips can be simulated.

Then, the output signal of adder 143 is weighted by means of being multiplied by a variable SLTGIN at a multiplier 144, and the weighted signal is then supplied to a slit function table 145. The slit function table 145 generates an opening area signal $S_L$, representing the opening area of a performer's lips, in response to the difference pressure signal $\Delta q$ which have been affected by the frequency response. This opening area signal $S_L$ is then supplied to the multiplier 149, and simultaneously multiplied by a feedback coefficient $\beta$ in the multiplier 146. The multiplication results are then returned to the subtracter 141.

As described above, according to the components 141~146 shown in FIG. 9, the opening area signal $S_L$ can be obtained in response to the difference pressure signal $\Delta q$, variables LPFR and QLR, and the embouchure data EMB.

Next, according to Graham's rule, the flux passing a unit area in a unit time, namely, air speed V can be expressed in the following formula (A1).

$$V=\sqrt{\{2(\Delta q)/\rho\}} \quad \text{(A1)}$$

Herein, $\rho$ is the air density.

The Graham function table 148 gives the air speed signal V according to the formula (A1) when the difference pressure signal $\Delta q$ is supplied. In the prior stage of Graham function table 148, a multiplier 147 is provided for adjusting the influences due to the Graham function, wherein the difference pressure signal $\Delta q$ is multiplied with a prespecified variable GRMGIN (i.e., Graham gain).

As described above, when the opening area signal $S_L$ and the air speed signal V are obtained, they are multiplied in the multiplier 149, and the multiplication results is generated as a flow signal F.

The flow signal F is then supplied to a multiplier 153 wherein the signal F is multiplied by a variable Z which represents the input impedance of the resonance tube. Then, the multiplication results are generated as the progressive pressure wave signal $q_o$ via an adder 155.

Incidentally, in the acoustic lip-reed wind instruments, a so called "repulsing sound" may occur due to the pressure wave being reflected in the mouthpiece. In order to simulate the repulsing sound, the circuit shown in FIG. 9 is provided with a repulsing function table 150. When the difference pressure signal $\Delta q$ is supplied to the table 150, a repulsing signal $S_{RP}$, which represents the repulsing sound, is then generated. The generated repulsing signal $S_{RP}$ is then modified in a high-pass filter (hereinafter, referred to as HPF) 151 and supplied to a multiplier 152. The characteristics of the HPF 151 is set when a coefficient HPFR is supplied to the HPF 151.

The repulsing signal $S_{RP}$, generated via the HPF 151, is then multiplied with the difference pressure signal $\Delta q$ in the multiplier 152, is further weighted by the variable REPGIN in a multiplier 154, and is supplied to the adder 155. Therefore, influences due to the repulsing sound is are imparted to the progressive pressure wave signal $q_O$.

FIGS. 10A and 10B respectively show the waveform of analog output signal generated by the DAC 103 and the frequency spectrum of the waveform analyzed by means of FFT (Fast Fourier Transform) analyzer. Furthermore, the waveform and frequency spectrum of opening area signal $S_L$, air speed signal V, and repulsing signal $S_{RP}$ are respectively shown in FIGS. 11A to 13B.

Incidentally, in order to practice a sound creation on the above-described algorithm, various parameters (variables) must be varied appropriately. However, in some cases, it is difficult to estimate how the musical tone changes in response to the change of parameters. Accordingly, in these cases, it is difficult to clarify the correspondence between the tone color and other parameters. Furthermore, there are some parameters which make the sound signals go out of tune or make the modulation stop when the parameters are changed. Therefore, considerable skill is required by engineers to ultimately obtain the sounds by means of changing various parameters.

Furthermore, electronic musical instruments are, preferably, provided with various types of manually operable members in order to permit the performers to change various parameters during the performance. However, due to the above reasons, parameters chosen by the performer must be limited, and it is therefore difficult for him to improve expressiveness.

SUMMARY OF THE INVENTION

It is accordingly a general object of the present invention to provide a musical tone synthesizing apparatus which permits easy sound creations.

In a first aspect of the present invention, there is provided a musical tone synthesizing apparatus comprising:

(a) linear operation means for progressing, delaying, and outputting, when the linear operation means receiving a progressive wave signal, the progressive wave signal;

(b) non-linear operation means for varying the signal outputted by the linear operation means according to a musical tone control signal, and generating the varied signal to the linear operation means as a new progressive wave signal; and (c) musical tone modification means for receiving a plurality of signals extracted from at least one of the linear operation means and the non-linear operation means, creating a first signal and a second signal based on the plurality of signals, varying the first signal in accordance with the second signal, and providing the varied first signal as a musical tone signal to be synthesized.

According to the present invention, the linear operation means receives the progressive wave signal and delays and generates the received signal. Then, the non-linear operation means varies the signal generated by the linear operation means in accordance with the musical tone control information and generates varied results as the new progressive wave signal. The musical tone modification means receives a plurality of signals from the linear operation means or the non-linear operation means, creates a first signal and a second signal from the plurality of signals, varies the first signal according to the second signal, and generates the varied first signal as a musical tone signal to be synthesized.

Therefore, while the musical tone signal is being generated, therefore will be no influence on the progressive wave signal. Accordingly, malfunctions such as modulation cessation, pitch fluctuations, and the like due to this influence can be prevented.

DESCRIPTION OF THE PREFERRED EMBODIMENT

A. Composition of the Embodiment

A-1 Overall Composition of the Embodiment

Figure 5:
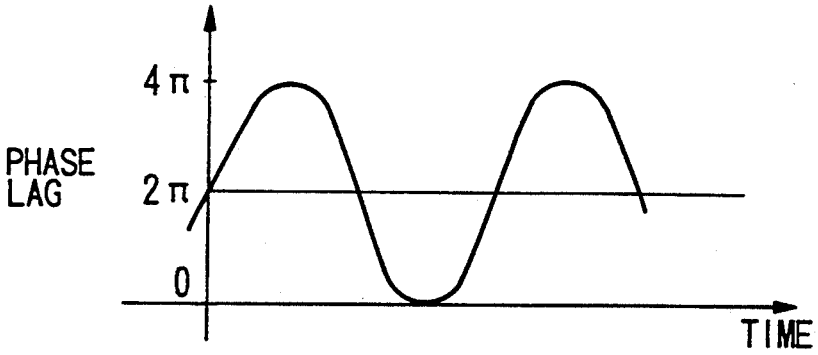
FIG. 5 is a schematic diagram of operating condition of the FM modulator 3.
Figure 6:
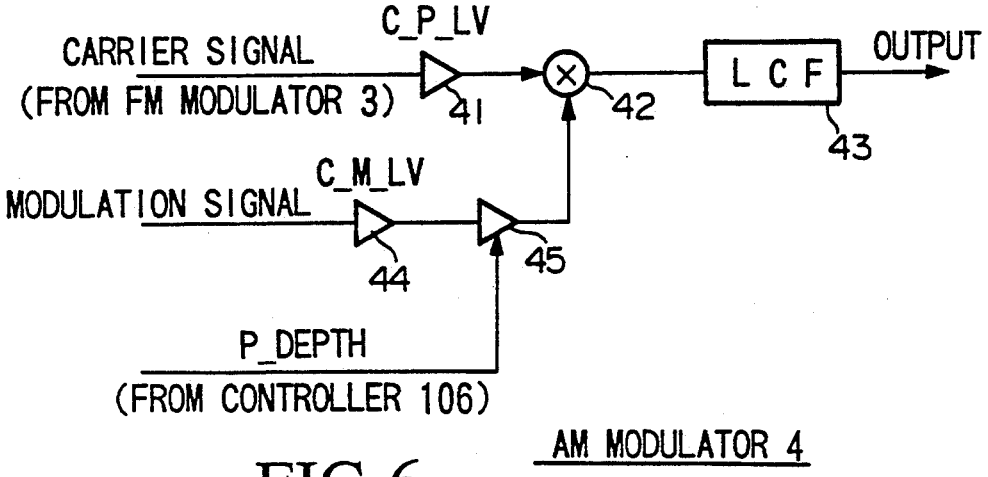
FIG. 6 is a block diagram of an AM modulator 4.
Figure 7:
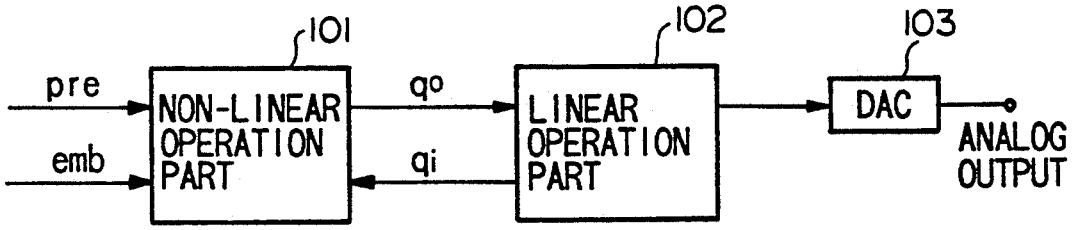
FIG.7 PRIOR ART
FIG. 7 is a block diagram of a conventional physical model sound source.
Figure 8:
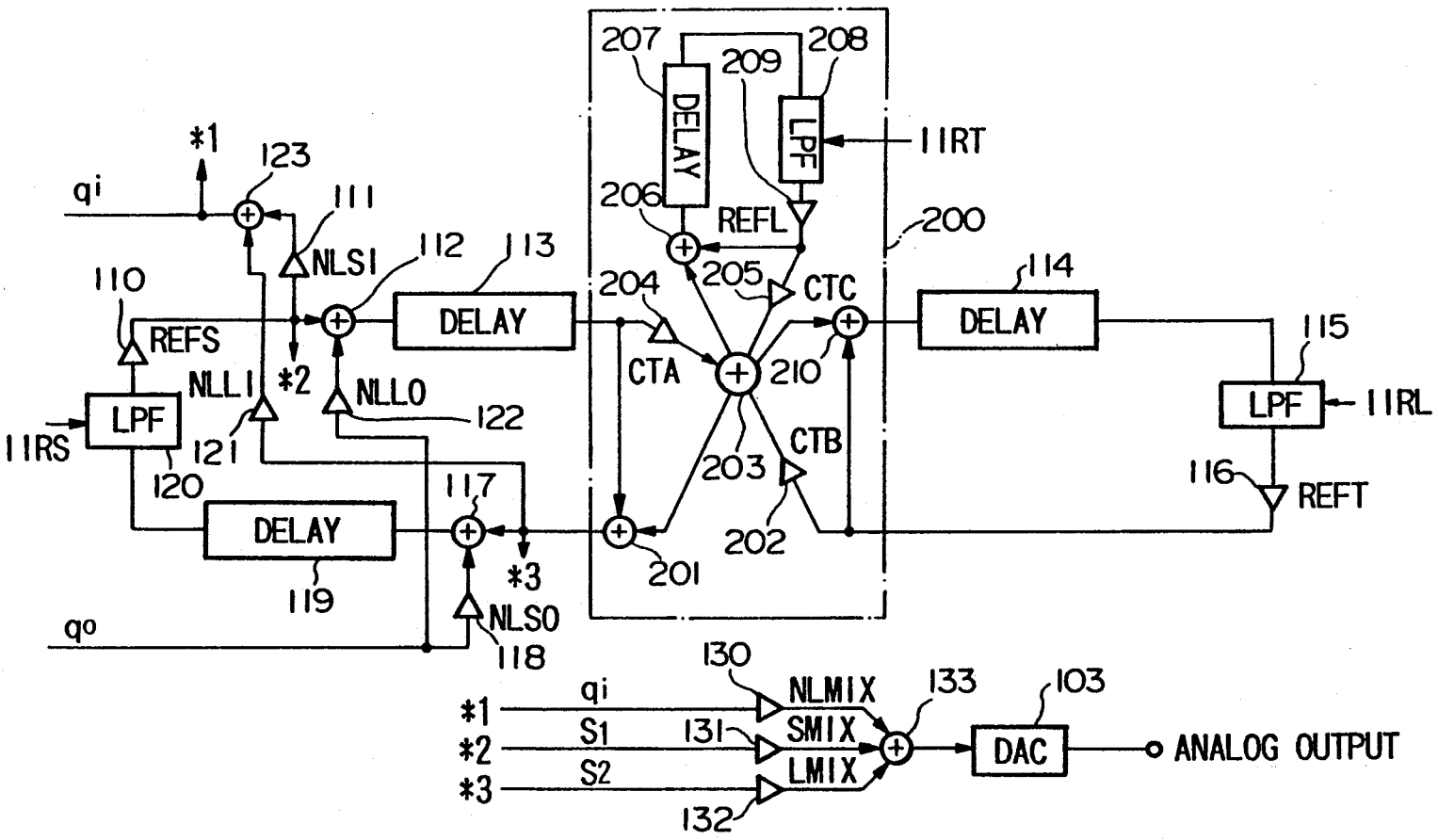
FIG. 8 is a block diagram of a linear operation part 102.
Figure 9:
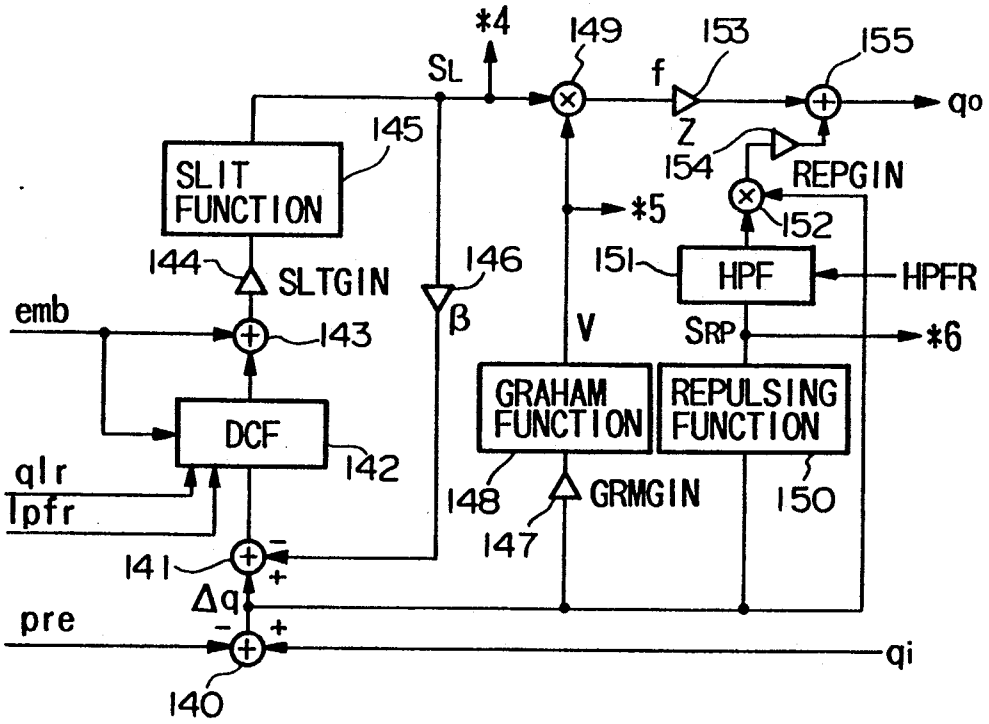
FIG. 9 is a block diagram of a non-linear operation part 101.
Figure 10A:
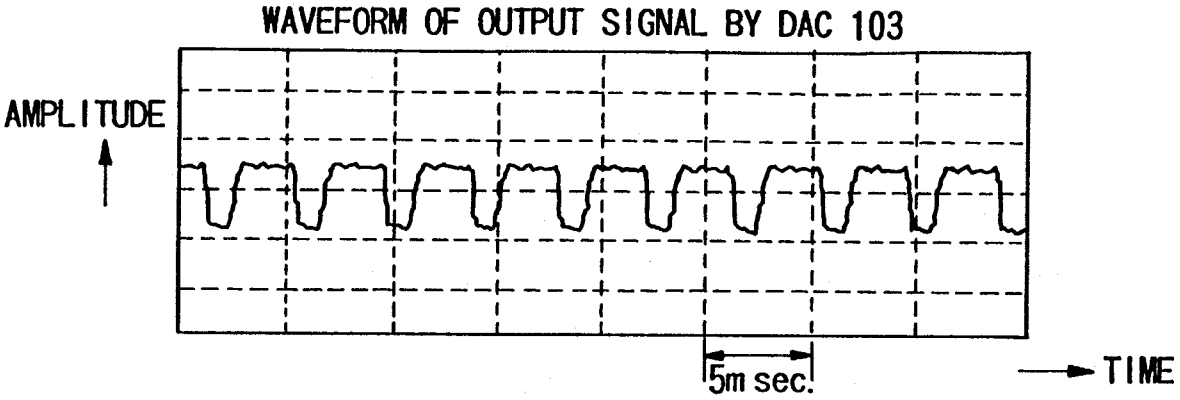
FIG. 10A is a waveform diagram of an analog output signal by a DAC 103.
Figure 10B:
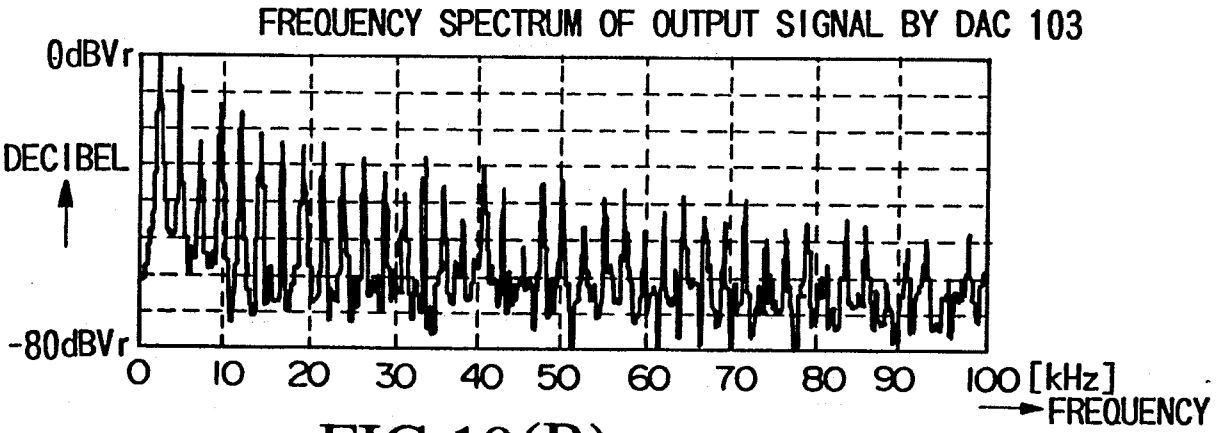
FIG. 10B is a frequency spectrum diagram of the analog output signal by the DAC 103.
Figure 11A:
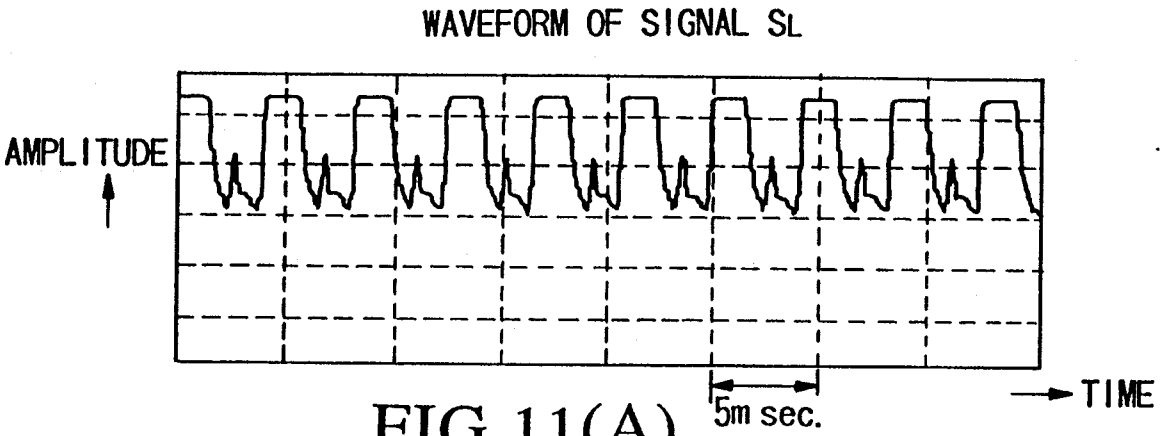
FIG. 11A is a waveform diagram of an opening area signal $S_L$.
Figure 11B:
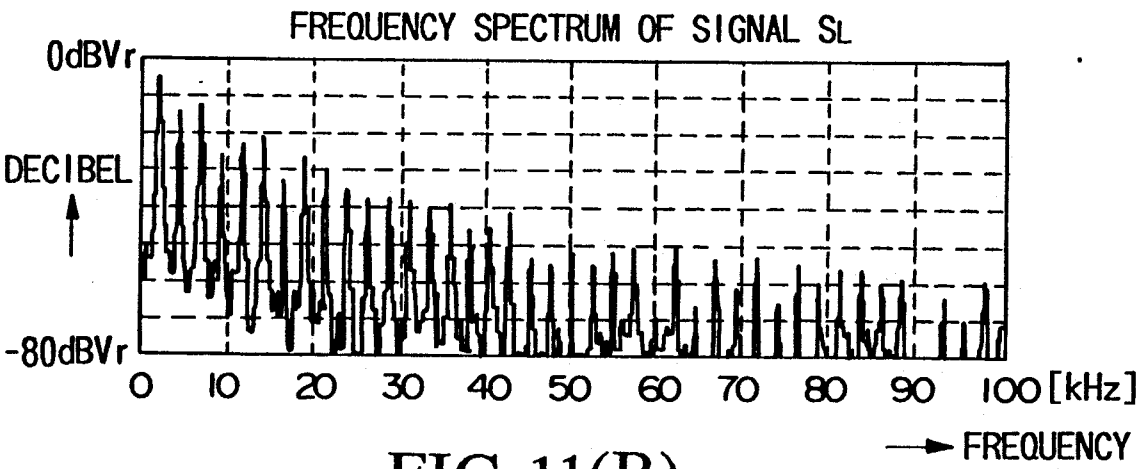
FIG. 11B is a frequency spectrum diagram of the opening area signal $S_L$.
Figure 12A:
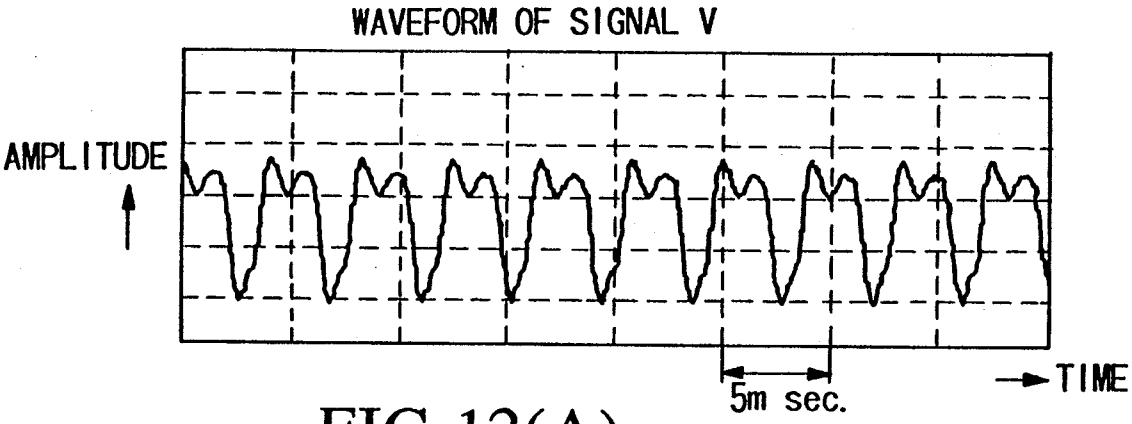
FIG. 12A is a waveform diagram of an air speed signal V.
Figure 12B:
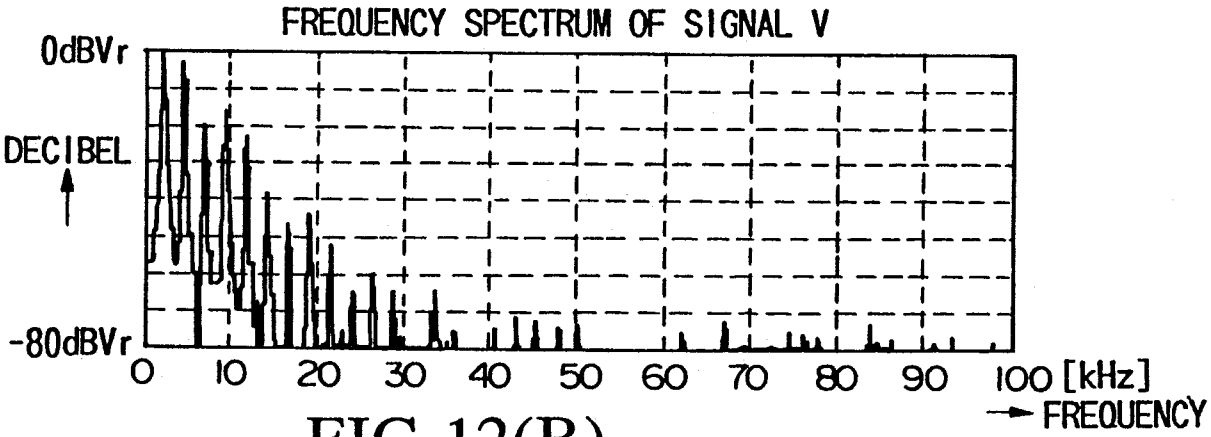
FIG. 12B is a frequency spectrum diagram of the air speed signal V.
Figure 13A:
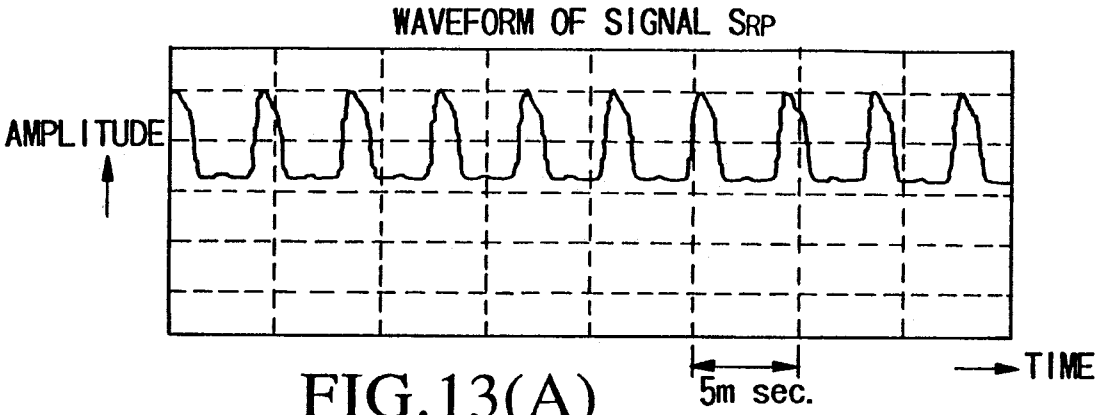
FIG. 13A is a waveform diagram of a repulsing signal $S_{RP}$.
Figure 13B:
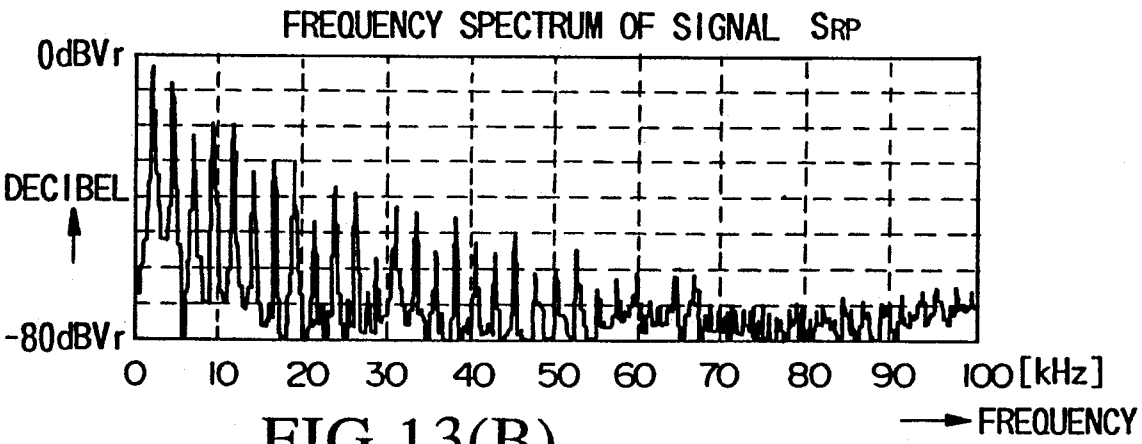
FIG. 13B is a frequency spectrum diagram of the repulsing signal $S_{RP}$.

Further objects and advantages of the present invention will be apparent from the following description, reference being made to FIGS. 1 to 6, the accompanying drawings, wherein components corresponding to those of FIGS. 7 to 9 will be referred to by the same numerals.

Figure 1:
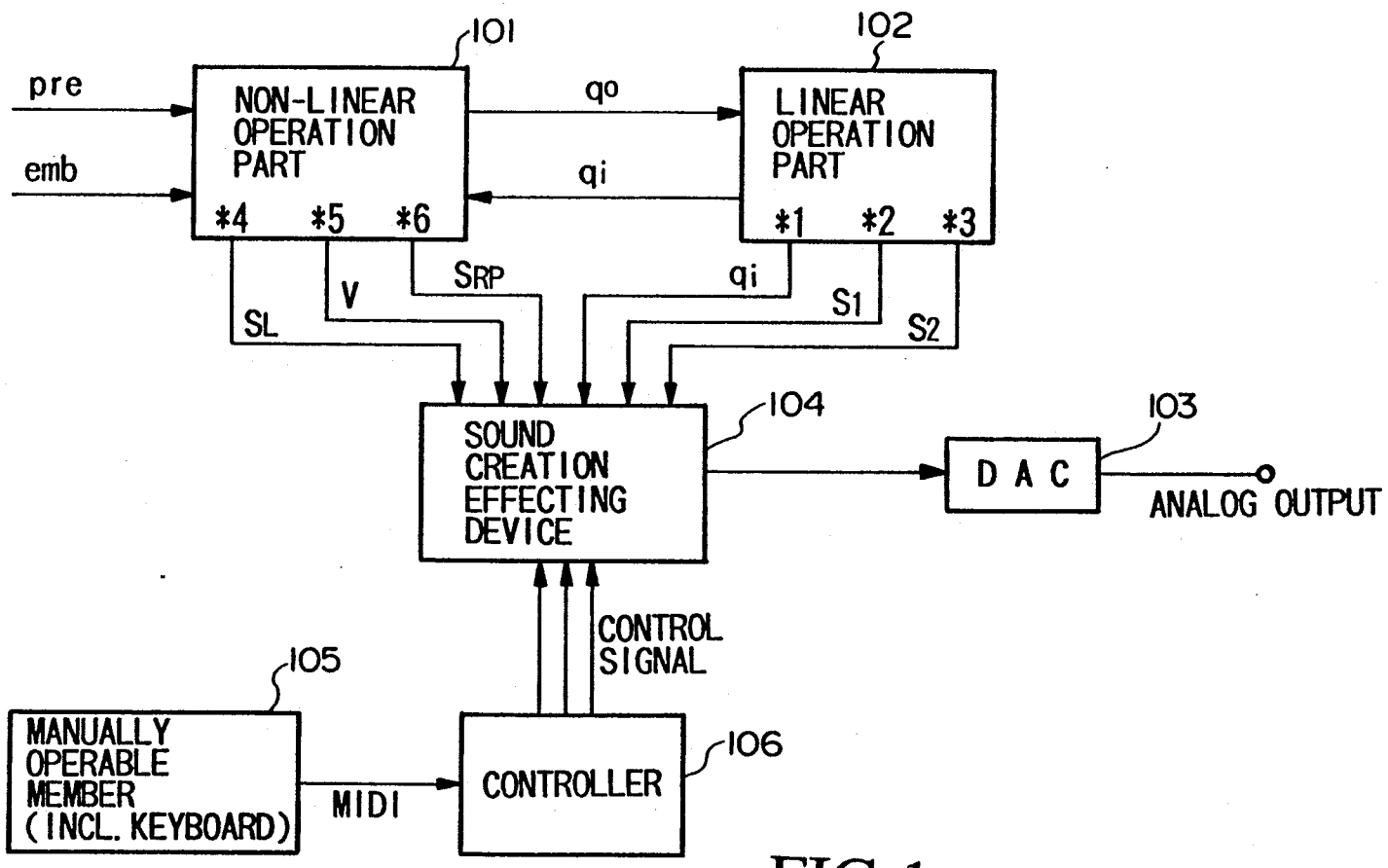
FIG. 1 is a block diagram showing an electronic configuration of an electronic musical instrument according to an embodiment of the present invention.

FIG. 1 is an overall block diagram showing an electronic musical instrument according an embodiment of the present invention.

In FIG. 1, the numeral 104 designates a sound creation effect device which receives the reflected pressure wave signal $q_i$, the signal $S_1$ the signal $S_2$, the opening area signal $S_L$, the air speed signal V, and the repulsing signal $S_{RP}$, respectively, from the non-linear operation part 101 and the linear operation part 102. The numeral 105 designates a manually operable member which consists of a keyboard and other various tone control manually operable members (not shown). The operating information generated by the manually operable member 105 is supplied to a controller 106 as the MIDI signal. The controller 106 generates musical tone control information in response to the supplied operating information. The above described musical tone control information indicates modulation depth, etc., concerning AM modulation and FM modulation executed in sound creation effecting device 104, the details of which will be described later.

The sound creation effecting device 104 then composes a musical tone signal corresponding to the signals respectively supplied by the non-linear operation part 101 and the linear operation part 102, and further corresponding to the control information supplied by the controller 106 and supplies the composed musical tone signal to the DAC 103.

A-2. Composition of Sound Creation Effecting Device 104

Next, details of the composition of the sound creation effecting device 104 will be described, reference being made to FIG. 2.

Figure 2:
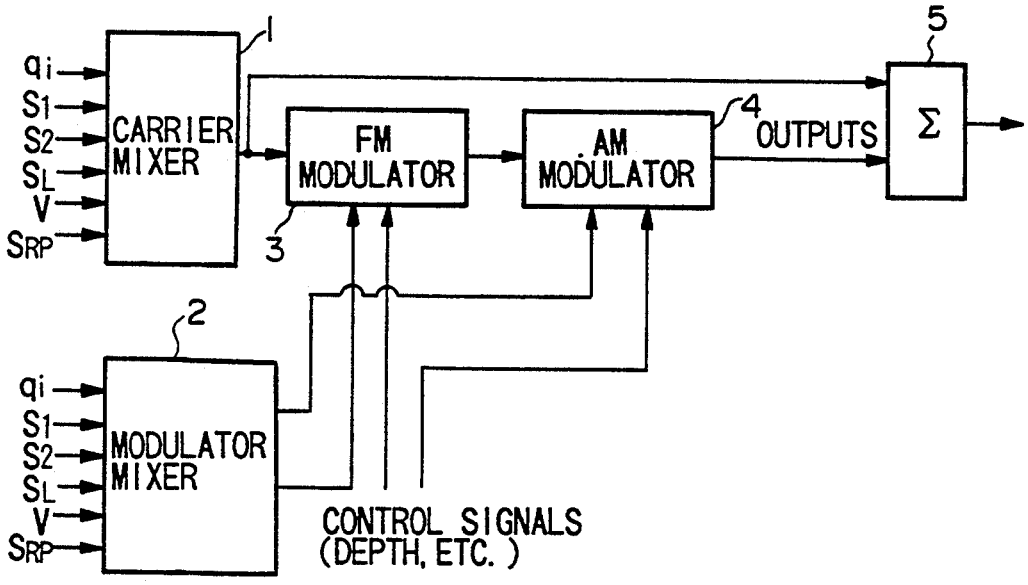
FIG. 2 is a block diagram of a sound creation effecting device 104.
Figure 3:
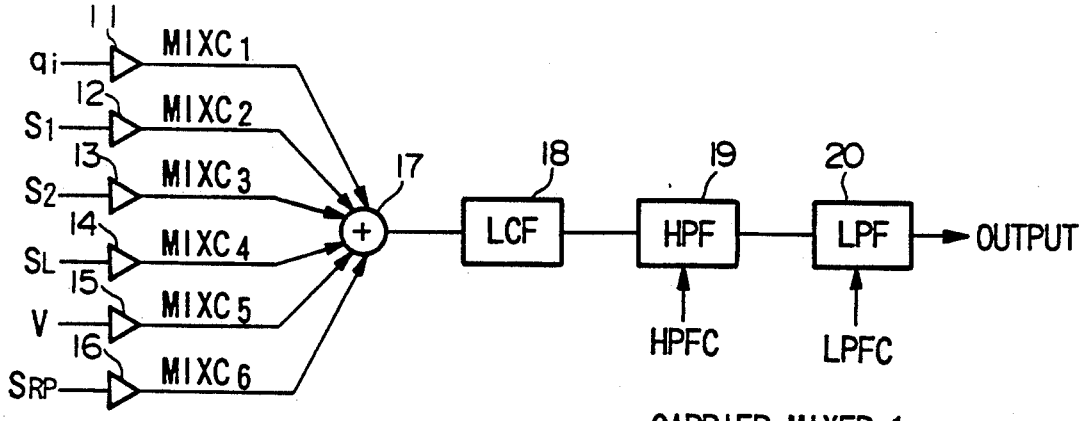
FIG. 3 is a block diagram of a carrier mixer 1.

In FIG. 2, the numeral 1 designates a carrier mixer which generates a carrier signal corresponding to the signals $q_i$, $S_1$, $S_2$, $S_L$, V, and $S_{RP}$. The circuit composition of the carrier mixer 1 is shown in FIG. 3. In FIG. 3, the signals $q_i$, $S_1$, $S_2$, $S_L$, V, and $S_{RP}$ are respectively multiplied by prespecified weighting variables $MIXC_1$ to $MIXC_6$ in multipliers 11 to 16; and the summary of the multiplication results are generated by an adder 17. The output signal of adder 17 is passed through the LCF (Low-Cut Filter) 18 so as to eliminate the DC components therein; is sequentially passed through a HPF 19 and a LPF 20 so as to execute the equalizing, namely, the sound creation; and is generated as a carrier signal. The cut-off frequencies of HPF 19 and LPF 20 are set according to prespecified variables HPFC and LPFC.

In FIG. 2, the numeral 2 designates a modulation signal mixer which generates modulation signal in response to the signals $q_i$, $S_1$, $S_2$, $S_L$, V and $S_{RP}$. The detailed composition of the modulation signal mixer 2 is similar to that of carrier mixer 1; however, variables, which corresponds to $MIXC_1$–$MIXC_6$, HPFC and LPFC in FIG. 3, will be independently set with variables in the carrier mixer 1.

A-3. Composition of FM modulator 3

Figure 4:
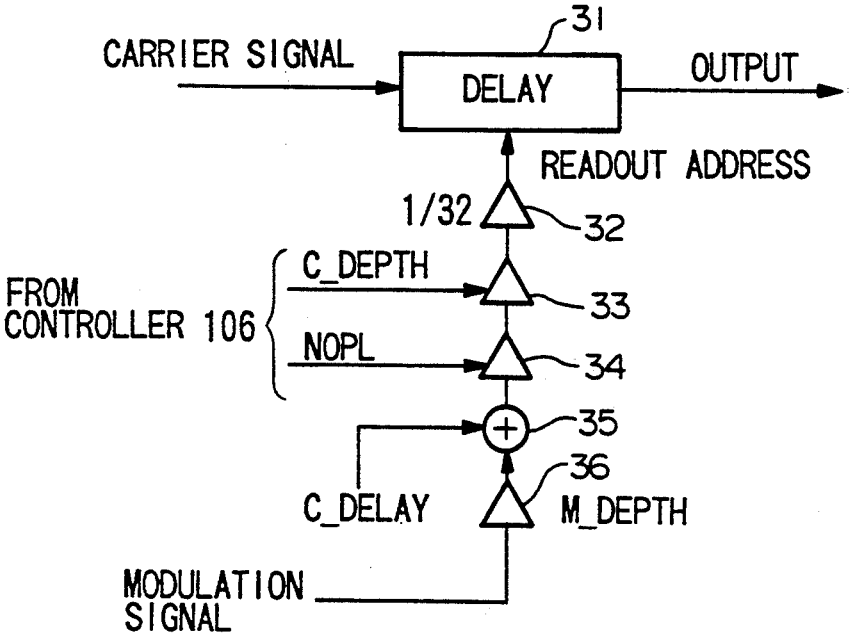
FIG. 4 is a block diagram of an FM modulator 3.

The carrier signal generated by the carrier mixer 1 is then supplied to an FM modulator 3 in which the carrier signal is FM modulated in accordance with the modulation signal generated by the modulation signal mixer 2 and with the control signal generated by the controller 106. The details of the modulation will be described below, reference being made to FIG. 4. In FIG. 4, the numeral 31 designates a delay circuit consisting the memory devices having a plurality of addresses. At every sampling period, the delay circuit 31 fetches the carrier signal and stores the fetched signal in the top address, the information stored in every address is to the latter adjacent address, and the information flew out from the last address is purged.

Furthermore, when readout address information is supplied by the multiplier 32, the delay circuit 31 generates the data stored in the address indicated by the information. Therefore, it is understood that if the readout address information remains a constant value, the carrier signal will be generated as it is after a prespecified time has passed; however, if the readout address information is varied, an FM modulated carrier signal will be generated by the circuit 31.

The modulation signal generated by the modulation signal mixer 2 is supplied to a multiplier 36 wherein the modulation signal is multiplied by a variable M_DEPTH representing the modulation depth. Then, the multiplied modulation signal is added with a variable C_DELAY in an adder 35, and the addition results are supplied to a multiplier 33 via a multiplier 34. Herein, the variable C_DELAY is a variable which indicates a delay time of the carrier signal together with a note-on pitch length data NOPL, the details of which will be described below.

In the multiplier 34, the modulation signal is multiplied by the note-on pitch length data NOPL. Herein, the note-on pitch length data NOPL represents a pitch of the musical tone at the note-on timing.

The reason the data NOPL being multiplied with the modulation signal will now be described.

When the carrier signal is FM modulated in a prespecified depth, as the pitch becomes longer (as the key becomes lower), the variation width of the readout address information becomes larger. Therefore, if the pitch is set to a large value, carrier signals recorded during a long period should be required, so that the value of readout address information must be enlarged. In contrast, if the pitch is set to a small value, the value of readout address information can be minimized. Therefore, the variable C_DELAY, indicating the center of the readout address information, is set to the larger value, as the modulation depth is set larger.

As described above, the center of the readout address information, namely, the readout address information of "0" modulation depth is determined on the basis of the variable C_DELAY and the note-on pitch length data NOPL.

This modulation signal is then multiplied by the variable C_DEPTH in the multiplier 33. The variable C_DEPTH, being utilized for controlling the modulation depth, is generated by the controller 106 together with the note-on pitch length data NOPL is response to the various operating information supplied by the manually operable member 105.

The modulation signal generated by the multiplier 33 is then supplied to the multiplier 32 wherein the modulation signal is multiplied by "1/32". More specifically, in order to improve the accuracy of FM modulation, the modulation signal is previously multiplied by "32", and further multiplied by "1/32" just when being supplied to the delay circuit 31.

Because the above-described components are provided, in the FM modulator 3, the carrier signal is delayed and is FM modulated in accordance with the modulation signal and various control signals supplied by the controller 106. For example, in the case where the variable M_DEPTH is "0", the variable C_DELAY is "1", and the variable C_DEPTH is "1", the carrier signal will be delayed one period. Similarly, the carrier signal is delayed for a half period when the variable C_DELAY is "0.5", and the carrier signal is delayed for a quarter period when the variable C_DELAY is "0.25". This variable C_DEPTH is preferably set according to the MIDI signal generated by the manually operable member 105.

More specifically, the MIDI signal, the value of which should be set from "OOH" to "7FH" in hexadecimal code, is transformed to the value from "0.0" to "1.0" in the controller 106, and the transformed results are generated as a variable C_DEPTH. As a result, the phase lag of the carrier signal can be controlled in real-time. For example, when the variable M_DEPTH is "1", the variable C_DELAY is "1", and the modulation signal is a sine wave having an amplitude of "1", the phase lag of the carrier signal applied in the delay circuit 31 will be set as shown in FIG. 5.

As described above, the modulation depth can be varied according to the variable M_DEPTH, so that the variable M_DEPTH is preferably set by means of manually operable member, etc. Furthermore, because the carrier signal is applied with delay time in FM modulator 3, there must be a time lag between the FM modulation executed in FM modulator 3 and AM modulation executed in an AM modulator 4, the details of which will be described below. Therefore, the delay time applied in the delay circuit 31 will give a considerable effect to the musical tone color.

A-4. Composition of AM Modulator 4

The carrier signal generated by the FM modulator 3 is then supplied to the AM modulator 4 in order to further execute an AM modulation. The details of the modulation will be described with reference being made to FIG. 6.

In FIG. 6, the carrier signal generated by the FM modulator 3 is multiplied by a variable C_P_LV, indicating the carrier power modulation level, in a multiplier 41. Similarly, the modulation signal generated by the modulation signal mixer 2 is multiplied by a variable C_M_LV, indicating the modulator power modulation level, in the multiplier 44. Therefore, the rate between the carrier signal and the modulation signal concerning the AM modulation can be determined by setting the variables C_P_LV and C_M_LV.

The modulation signal generated by the multiplier 44 is further multiplied by a variable P_DEPTH in a multiplier 45. The variable P_DEPTH, indicating the AM modulation depth, is created by the controller 106 in response to the MIDI signal generated by the manually operable member 105. More specifically, as above-described, the MIDI signal can take "OOH" to "7FH" in hexadecimal code as its value. This value is transformed to a value from "0.0" to "1.0" in the controller 106, and the transformed value is generated as the variable P_DEPTH.

Then, a carrier signal generated by the multiplier 41 is multiplied in the multiplier 42 by the modulation signal generated by the multiplier 45. As a result, the carrier signal is AM modulated with the modulation signal. The output signal of the multiplier 42 is further supplied to a LCF (Low-Cut Filter) 43 wherein the DC component of the signal is eliminated.

Then, as in FIG. 2, the output signal of the AM modulator 4 is supplied to an adder 5 wherein the signal is composed with the carrier signal generated by the carrier mixer 1. Then, the composed signal is generated as the musical tone signal. This musical tone signal is converted to an analog signal by the DAC 103 (see FIG. 1). Incidentally, various types of equalizers and resonance circuits can be provided between the adder 5 and the DAC 103.

B. Operation of the embodiment

Hereinafter, the operation of this embodiment will be described with reference being made to FIG. 6.

First of all, when the non-linear operation part 101 receives the blow pressure signal PRE and embouchure signal EMB, the progressive pressure wave signal $q_0$ is generated accordingly and supplied to the linear operation part 102. In the linear operation part 102, the progressive pressure wave signal $q_0$ is delayed and attenuated while progressing the part 102, and then returned to the non-linear operation part 101 as the reflected progressive wave signal $q_i$.

Thus, the non-linear operation part 101 and the linear operation part 102 respectively exchange the signals, progression of the progressive pressure wave and the reflection pressure wave respectively occurring in the wind instruments can be simulated.

Then, signals $q_i$, $S_1$, $S_2$, $S_L$, V, and $S_{RP}$ are extracted from the non-linear operation part 101 and linear operation part 102, and are supplied to the sound creation effecting device 104. In the sound creation effecting device 104, the carrier signal and the modulation signal are composed according to the supplied signals; the carrier signal is FM modulated and AM modulated with the modulation signals; and the modulated signal is supplied to the DAC 103 as the musical tone signal.

At the same time, the keyboard and the various types of manually operable members provided in the manually operable member 105 are operated by the operator. The operating information thereof is supplied to the controller 106 as the MIDI signal. In the controller 106, various types of control signals are generated according to the supplied operating information, so that various parameters in the sound creation effecting device 104 are set accordingly.

As described heretofore, according to the embodiment of the present invention, the sound creation effect device 104 wherein the sound creation is executed is provided outside of the loop circuit wherein the progressive pressure wave signal $q_0$ and the reflected progressive wave signal $q_i$ are progressed. Therefore, no matter how parameters are set, it is possible to prevent out-of-tune generation and cessation of modulation.

Furthermore, according to the embodiment, the variable C_DEPTH representing the FM modulation depth, the variable P_DEPTH representing the AM modulation depth, and the like are utilized for sound creation. Therefore, it is easy to estimate how the musical tone change in response to the changes of parameters, and therefore, to execute the desired sound creation.

Furthermore, because the non-linear operation part 101 and the linear operation part 102 are provided, advantages of the physical model sound source, namely, the musical tone being controlled by the blow pressure signal PRE and embouchure signal EMB, etc., are maintained in the embodiment.

The preferred embodiment described heretofore are illustrative and not restrictive. Therefore, this invention may be practiced or embodied in still other ways without departing from the spirit or essential character thereof.

For example, according to the above embodiment, the signal generated by the carrier mixer 1 is formerly FM modulated and then AM modulated; however, the AM modulation may be executed before the FM modulation, or either one of the AM and FM modulations may be executed. Alternatively, FM and AM modulations may be executed independently, and respective modulated signals may be combined so as to create musical tone signal.

What is claimed is:

1. A musical tone synthesizing apparatus comprising:

parameter generating means for generating a first parameter and a second parameter which control a characteristic of a musical tone to be generated;

non-linear operation means for producing a non-linear signal in accordance with said first parameter;

linear operation means connected to receive the non-linear signal from said non-linear operation means and for conducting a linear operation on said non-linear signal in accordance with said second parameter to produce a modified non-linear signal, wherein said non-linear operation means further receives said modified non-linear signal, conducts a non-linear operation on said modified non-linear signal in accordance with said first parameter and produces a revised non-linear signal so as to supply said revised non-linear signal to said linear operation means as said non-linear signal; and modulation operation means for performing a modulation operation using said non-linear signal from the non-linear operation means and said modified non-linear signal from the linear operation means and for producing the modulated signal as said musical tone signal.

2. A musical tone synthesizing apparatus according to claim 1, wherein said modulation operation means modulates said non-linear signal in accordance with said modified non-linear signal.

3. A musical tone synthesizing apparatus according to claim 1, wherein said modulation operation including at least one of an amplitude modulation and a frequency modulation.

4. A musical tone synthesizing apparatus according to claim 1, wherein the linear operation means is provided with delay means which delays said non-linear signal inputted therein by a delay time corresponding to the musical tone signal.

5. A musical tone synthesizing apparatus according to claim 1, further comprising:

(d) musical tone control signal generating means for generating a musical tone control signal in response to a performance operation by a player, said non-linear operation means and said linear operation means being responsive to said musical tone control signal.

6. A musical tone synthesizing apparatus according to claim 1 further comprising:

creating means for creating a first signal based on said non-linear signal and creating a second signal based on said modified non-linear signal, said modulation operation being conducted on said first and second signals so as to produce said musical tone.

7. A musical tone synthesizing apparatus according to claim 1, wherein said modulation operation means modulates said modified non-linear signal in accordance with said non-linear signal.

8. A musical tone synthesizing apparatus according to claim 1, wherein said non-linear operation means includes a non-linear table with which said non-linear operation is conducted.

9. A musical tone synthesizing apparatus according to claim 1, wherein said first parameter includes a signal representing a pressure.

10. A musical tone synthesizing apparatus according to claim 1, wherein said linear operation means including delay means for delaying said non-linear signal as said linear operation, wherein said second parameter corresponds to a desired pitch of said musical tone signal so as to control a delay amount of said delay circuit in accordance with said pitch.

11. A musical tone synthesizing apparatus according to claim 1 further comprising:

modulation control signal generating means for generating a modulation control signal determining a modulation manner, said modulation operation means conducting said modulation operation in a manner determined by said modulation control signal.

12. A musical tone synthesizing apparatus according to claim 11 wherein said modulation control signal generating means including a operable member, said modulation control signal being controlled by an operation amount of said operable member.

13. A method for synthesizing a musical tone signal, the method comprising the steps of:

generating a progressive wave signal based on a non-linear operation with respect to a feedback signal;

progressing and delaying the progressive wave signal by means of a loop circuit which performs a linear operation and generating a processed progressive wave signal, said processed progressive wave signal being fed back as the feedback signal;

extracting the progressive wave signal and the processed progressive wave signal;

creating a first signal based on the progressive wave signal and a second signal based on the processed progressive wave signal; and modulating one of the first signal and the second signal according to the other one of the first signal and the second signal, and providing the modulated signal as a musical tone signal.

14. A method for synthesizing musical tone signal according to claim 13, wherein at least one of frequency modulation and amplitude modulation are performed.

* * * * *